United States Patent [19]

Jackson

[11] 4,402,804

[45] Sep. 6, 1983

[54] ELECTROLYTIC SYNTHESIS OF ARYL ALCOHOLS, ARYL ALDEHYDES, AND ARYL ACIDS

[75] Inventor: Patricia J. Jackson, Barberton, Ohio

[73] Assignee: PPG Industries, Inc., Pittsburgh, Pa.

[21] Appl. No.: 379,219

[22] Filed: May 17, 1982

[51] Int. Cl.[3] ..... C25B 3/02; C25B 3/04

[52] U.S. Cl. ..... 204/73 R; 204/78

[58] Field of Search ..... 204/78–80, 204/73 R, 263, 265–266

[56] References Cited

U.S. PATENT DOCUMENTS

| | | | |
|---|---|---|---|
| 3,288,692 | 11/1966 | Leduc | 204/263 |
| 3,714,003 | 1/1973 | Engelbrecht et al. | 204/78 |
| 3,726,914 | 4/1973 | Engelbrecht et al. | 260/524 |
| 4,148,696 | 4/1979 | Halter | 204/79 |
| 4,298,438 | 11/1981 | Degner | 204/78 |
| 4,318,783 | 3/1982 | Buhmann | 204/79 |

OTHER PUBLICATIONS

"The Electrochem. Oxidation of Toluene to Benzaldehyde" by Mann et al., AES Gen. Meeting 4–23–25, Advanced Copy, pp. 31–42.

Fichter, "Electrochemical Oxidation of Aromatic Hydrocarbon", Electrochemical Society Reprint, 1924.

McKee et al., "Electro-organic Oxidation in Concentrated Aqueous Organic Salt Solution", Electrochemical Society Advanced Copy, 1934.

*Primary Examiner*—R. L. Andrews

*Attorney, Agent, or Firm*—Richard M. Goldman

[57] ABSTRACT

Disclosed is a method of synthesizing compounds chosen from the group consisting of benzyl alcohol, benzaldehyde, benzoic acid, phenoxy benzyl alcohol, phenoxy benzaldehyde, phenoxy benzoic acid, and mixtures thereof by providing a composition of a current carrying component, such as a fluoroborate salt or a tetraethylammonium salt, a solvent, and a methyl aryl compound in contact with an anode and cathode. The solvent is reduced at the cathode and the methyl substituted aryl at the anode whereby to form product. According to an alternative exemplification of the invention, the anode and cathode are separated by a permionic membrane and a source of oxygen is provided in contact with the cathode and the permionic membrane.

12 Claims, 1 Drawing Figure

ELECTROLYTIC SYNTHESIS OF ARYL ALCOHOLS, ARYL ALDEHYDES, AND ARYL ACIDS

Aryl alcohols, exemplified by benzyl alcohol and phenoxy benzyl alcohol, aryl aldehydes, exemplified by benzaldehyde and phenoxy benzaldehyde, and aryl acids, exemplified by benzoic acid and phenoxy benzoic acid find utility as intermediates for the synthesis of biologically active compounds. One method of producing oxygenated aryl alkyls is the catalytic oxidation of the aryl alkyl, e.g., toluene or phenoxy toluene. This may be carried out using a homogeneous catalyst, a heterogeneous catalyst, or reacting the toluene with an active source of oxygen.

It has previously been proposed to carry out the oxidation of toluene electrolytically at a high oxygen overvoltage anode, for example at a lead dioxide anode, utilizing the toluene as a depolarizer for the high oxygen overvoltage anode, whereby to avoid the formation of molecular oxygen at the anode.

Moreover, the electrolytic oxidation of toluene in an aqueous, acidic anolyte favors the formation of benzaldehyde. Additionally, attempts to increase the yield of benzoic acid have resulted in the formation of dark, tarry products, believed to be hydroxylated or phenolic products.

It is proposed to synthesize compounds chosen from the group consisting of aryl alcohols, aryl aldehydes, aryl acids, and mixtures thereof by the electrolytic oxidation of the corresponding alkyl aryl, that is, the alkyl aryl itself being oxidized at the anode according to the reaction scheme shown below for toluene;

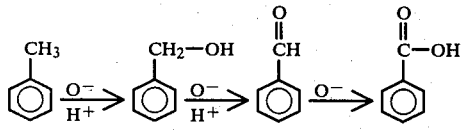

without the formation of phenolics, that is, without the formation of deleterious materials having meta and para hydroxylation and characterized by the appearance of tarry, dark materials.

The method herein contemplated may be carried out by the provision of a current carrying component, e.g., a supporting electrolyte or a solid polymer electrolyte, between the anode and cathode, which carries the charged species from electrode to electrode.

DETAILED DESCRIPTION OF THE INVENTION

As used herein, the term alkyl substituted aryl means an alkyl substituted mononuclear aromatic, exemplified by alkyl benzenes and phenoxy alkyl benzenes. As used herein, the methyl substituted aryl means a methyl substituted mononuclear aromatic having the structure

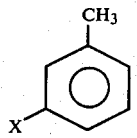

where X is defined below; such compounds are exemplified by toluene and phenoxy toluene. As used herein, the term aryl alcohols means an alcohol substituted mononuclear aromatic having the structure

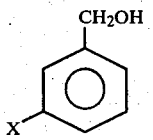

and exemplified by benzyl alcohol and phenoxy benzyl alcohol. As used herein, the aryl aldehyde means an aldehyde substituted mononuclear aromatic having the structure

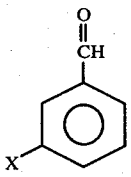

and exemplified by benzaldehyde and phenoxy benzaldehyde. As used herein, the term aryl acid means a carboxylic acid substituted mononuclear aromatic having the structure

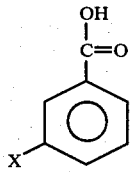

and exemplified by benzoic acid and phenoxy benzoic acid.

As used in the above structural representations, X is chosen from the group consisting of —H, and phenoxy, halogenated phenoxy, halogenated alkyl phenoxy, and halogenated alkyl halo phenoxy groups, represented by the formula

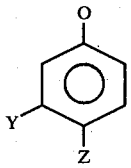

where Y and Z are independently selected from the group consisting of —H, $—CF_3$, $—C_2F_5$, $—CCl_3$, $—C_2Cl_5$, —F, and —Cl. Most commonly Y and Z are independently chosen from the group consisting of —H, —Cl, and $—CF_3$. In a particularly preferred exemplification, X is a 2-chloro-4-trifluoromethyl phenoxy group. As used herein, the term phenoxy includes both compounds having substituents on the phenoxy aromatic group and compounds having an unsubstituted phenoxy aromatic group.

It has been found that compounds chosen from the group consisting of benzyl alcohol, benzaldehyde, benzoic acid, mixtures thereof, and phenoxy benzyl alcohols, phenoxy benzaldehydes, phenoxy benzoic acids and mixtures thereof, may be synthesized by the electrolytic oxidation of toluene and phenoxy toluenes, respectively, that is, the toluene or phenoxy toluene itself being oxidized at the anode, according to the following reaction path

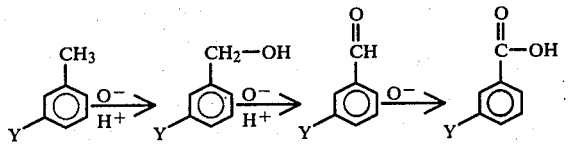

without the formation of phenolics, that is, without the formation of undesired, deleterious materials having meta and para hydroxylation, and characterized by a dark, tarry appearance.

It has been found that the electrolytic oxidation synthesis may be carried out by several alternative means, using low oxygen overvoltage anodes, e.g., platinum mesh, platinized platinum, and platinum coated metal mesh, and by the presence of a current carrying component at the anode and cathode, which current carrying component carries the charged species from electrode to electrode. The current carrying component, which may, in certain exemplifications, be a supporting electrolyte, is exemplified by quaternary ammonium salts and by tetrafluoroborate salts. In alternative exemplifications disclosed herein, the current carrying component may be a solid matrix of immobilized, charged sites situated between the anode and the cathode.

In one exemplification, a composition of toluene, solvent, and current carrying component is prepared. This composition is maintained in contact with the anode and cathode, a solvent being reduced at the cathode and toluene or phenoxy toluene being oxidized at the anode.

The composition of supporting electrolyte, solvent, and toluene or phenoxy toluene typically contains from about 1 to about 20 parts by weight of supporting electrolyte per part of toluene or phenoxy toluene, from about 10 to about 100 parts by weight of solvent per part of toluene or phenoxy toluene.

The current carrying components useful in one exemplification of the method herein contemplated are those materials which are capable of carrying a charge from an anode through a liquid to a cathode or from a cathode through a liquid to an anode, and remaining chemically unchanged after the reaction. Especially preferred are the quaternary ammonium salts having the formula $$NR_4{+}X^-$$

where R is $C_1$ to $C_4$ alkyl group, most commonly a $C_2$ alkyl group and $X^-$ is an anion. Exemplary anions include perchlorates and tetrafluoroborates. Especially preferred are tetrafluoroborate anions, $$BF_4^-$$

Alternatively, the current carrying component may be a tetrafluoroborate salt of a simple cation for example, an alkali metal salt of a tetrafluoroborate. Exemplary are lithium tetrafluoroborate, sodium tetrafluoroborate, and potassium tetrafluoroborate.

The solvent may either contain reducable oxygen or reducible oxygen may be otherwise introduced to the cathode. Typical solvents which contain reducible oxygen include aqueous solvents such as water and compositions of water and an organic solvent. Exemplary organic solvents which may be present with water include acetonitrile, dimethyl sulfoxide, benzonitrile, methanol, and acetic acid.

Alternatively, the solvent may be an organic solvent. Exemplary organic solvents are those solvents that are not oxidized to an appreciable extent at the anode, and include acetonitrile and dimethyl sulfoxide.

An especially preferred solvent is water containing from about 2 parts acetonitrile to about 20 parts acetonitrile per part of water.

Alternatively, reducible oxygen may be otherwise introduced to the system, for example by bubbling oxygen to the cathode.

In the exemplification herein contemplated where the anode directly faces the cathode without a membrane, barrier, or solid matrix of ionic sites interposed therebetween, the anode and cathode are preferably a low cathodic hydrogen evolution overvoltage, low anodic oxygen evolution overvoltage electrode pair. Exemplary are platinum group metals, base metals coated with platinum group metals, platinum group metals of enhanced activity, and active transition metals, for example, high surface forms of nickel. Especially preferred are platinum electrodes, platinum black electrodes, and platinum coated metal electrodes. The form of the electrodes may be sheets, plates, screens, mesh or the like.

According to an exemplification where oxygen is bubbled in the vicinity of the cathode, the cathode may be a high hydrogen evolution overvoltage cathode whereby to favor the reduction of the oxygen from molecular oxygen to superoxide, $O_2^-$.

In the method herein contemplated where the anode and cathode face each other, the electrolyte may be a stagnant pool of electrolyte as in a batch process. Alternatively, the electrolyte may move through the electrolytic cell for a continuous or semi-continuous process. In one form of this exemplification, a permeable anode and cathode are in a tubular electrolytic cell and the composition flows through the cathode to and through the anode whereby to control the residence time at the anode. In this way, the production of benzyaldehyde may be minimized, favoring the production of either benzyl alcohol or benzoic acid.

According to an alternative exemplification of the invention disclosed herein, there is provided as the current carrying component, a solid matrix having immobilized ionic sites between the anode and the cathode, the solid matrix preferably being in contact with the anode and cathode. Exemplary solid matrices characterized by the presence of immobilized ionic sites include solid polymer electrolytes, ceramic solid electrolytes, and various porous materials having ion exchange resin material or ionic sites immobilized therein. In the exemplification herein contemplated having a solid matrix with immobilized ionic sites interposed between the anode the cathode, a composition containing toluene or phenoxy toluene is provided in contact with the solid matrix and the anode. The toluene or phenoxy toluene may either be present in a solution with solvent or may be neat toluene or phenoxy toluene. The composition containing a reducible source of oxygen is provided in contact with the cathode and the solid matrix, for example, a composition of an aqueous or an organic material. An electrical current is passed through the cell whereby to reduce the reducible source of oxygen at the cathode and oxidized toluene at the anode.

The solid matrix may be a permionic membrane having anion selectivity whereby to pass oxygen therethrough, for example, a permionic membrane having sulfonamide, or amine active groups. Alternatively, it may be a porous matrix with ionic sites therein and therethrough.

The electrodes may be spaced from the solid matrix of immobilized ionic sites. Preferably the electrodes are in contact with the solid matrix whereby to avoid the need for solvent and current carrying components in the combustion, i.e., supporting electrolyte. The electrodes may be in the form of fine mesh, wire, screen, or the like, and are formed of the materials described hereinabove.

In the exemplification herein contemplated where a solid matrix is interposed between the anode and cathode, toluene or phenoxy toluene is fed to the anolyte compartment and the reducible oxygen-containing material is fed to the catholyte compartment. The reducible oxygen-containing material may be an aqueous catholyte, or oxygen passed to and through the cathode, especially a high hydrogen evolution overvoltage cathode whereby to form the superoxide ion. In this way there is recovered an anolyte product of aryl alcohol, aryl aldehyde, aryl acid, or a combination thereof.

DESCRIPTION OF THE DRAWING

According to a further exemplification of the invention illustrated in FIG. 1, toluene or phenoxy toluene, indicated as Ar—$CH_3$, 11, may be fed to the anolyte compartment 3 of electrolytic cell 1, and oxidized at the anode to form aryl alcohol and aryl aldehyde, 13. Thereafter, the liquid anolyte composition of aryl alcohol, aryl aldehyde and methyl aryl, 13 is recovered from the anolyte compartment 3, and the aryl alcohol is separated from the composition in drier, 21, i.e., by the use of a hygroscopic composition, for example, calcium chloride or silica gel. The aldehyde and methyl are then returned, e.g., through line 25, to the catholyte compartment 5 where the aldehyde is reduced to alcohol 27 at the cathode. The hygroscopic material is dried, in drier 31, whereby to recover alcohol 33 and recycle hygroscopic material 35.

Exemplary hygroscopic materials are those materials which preferentially remove alcohols from solutions of alcohols, aldehydes, and hydrocarbons. Exemplary materials include anhydrous calcium chloride, and anhydrous silica gel, both of which may thereafter be separated from the benzyl alcohol by heating.

Figure 1:
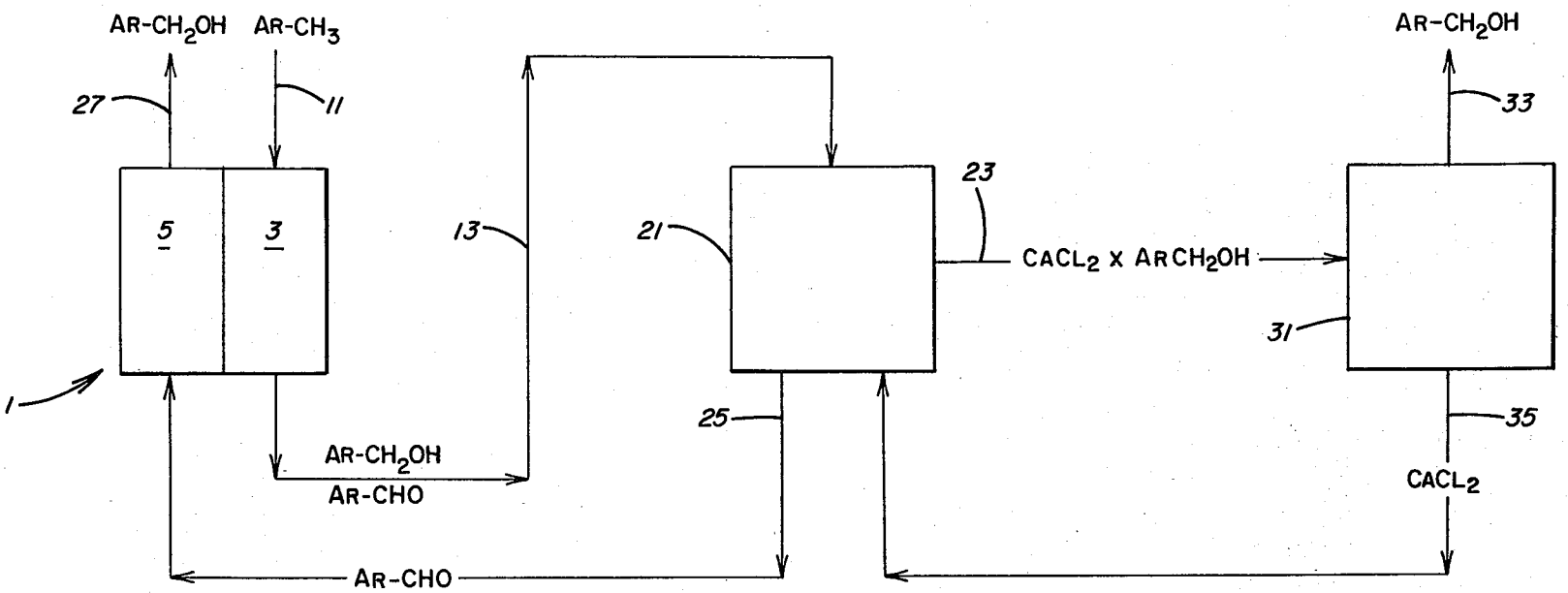

The following examples are illustrative of the method of this invention.

EXAMPLE I

Toluene was electrolytically oxidized to yield a mixture of benzyl alcohol, benzaldehyde, and benzoic acid.

An electrolytic cell formed of 150 milliliter beaker and an 8 centimeter, closed end, 14 millimeter outside diameter glass tube joined at the bottom through a glass wool packed arm, was utilized. The anode was platinum gauze and the cathode was a 16 square centimeter platinum gauze rolled into a 1 centimeter diameter tube.

The electrolyte was prepared by adding 1 milliliter of toluene and 2.3 grams of tetraethylammonium perchlorate to 100 milliliters of acetonitrile. The electrolyte was then poured into the electrolytic cell. Electrolysis was commenced at a current of 53 milliamperes, which gave a voltage of 1.7 volts. After 6 hours, electrolysis was discontinued.

The anolyte and catholyte were separately worked up by evaporation, extraction with diethyl ether, filtration of the tetraethyl ammonium perchlorate, and distillation of the ether. The resulting anolyte and catholyte products were separately analyzed by gas chromatography and found to contain benzyl alcohol, benzaldehyde, and benzoic acid.

EXAMPLE II

Toluene was electrolytically oxidized to yield a mixture of benzyl alcohol, benzaldehyde, and benzoic acid.

A 150 beaker electrolytic cell was utilized. The 150 milliliter beaker had a platinum gauze anode, a graphite cathode, and an inlet to bubble oxygen through the electrolyte.

An electrolyte was prepared containing 1 milliliter of toluene and 217 grams of tetraethyl ammonium tetrafluoroborate in 110 milliliters of acetonitrile. The electrolyte was poured into the beaker cell, and oxygen was continuously bubbled through the electrolyte.

Electrolysis was carried out at a cell voltage of 3.10 volts, and a current that was initially above about 20 milliamperes. After 24 hours the current fell to about 10.8 milliamperes, and after 36 hours the current fell to 1.5 milliamperes.

The electrolyte was then worked up by evaporation, extraction with diethyl ether, filtration of the tetraethylammonium tetrafluoroborate, and distillation of the diethyl ether. The product was analyzed by gas chromatography and infra-red spectroscopy and found to contain benzyl alcohol, benzaldehyde, and benzoic acid.

EXAMPLE III

Toluene was electrolytically oxidized to benzyl alcohol, benzaldehyde, and benzoic acid.

A composition was prepared containing 1 milliliter of toluene, 2 grams of tetraethyl ammonium tetrafluorobrate, and 10 milliliters of water in 92 milliliters of acetonitrile. This composition was placed in an electrolytic cell having a platinum gauze anode spaced 2 centimeters from a platinum cathode.

Electrolysis was carried out at a cell voltage of about 3.30 to 3.40 volts for six hours. Thereafter the composition was removed, and the product recovered as described in Example I hereinabove. The product was then analyzed by infrared spectroscopy and found to contain benzyl alcohol, benzaldehyde, and benzoic acid.

EXAMPLE IV

The procedure of Example III was followed except that the composition contained 2 milliters of toluene. The electrolysis was carried out for fifteen hours. The product was found by IR spectroscopy to contain benzyl alcohol, benzaldehyde, and benzoic acid.

EXAMPLE V

Toluene was electrolytically oxidized to yield benzyl alcohol, benzaldehyde, and benzoic acid.

A composition was prepared containing 2.6 grams of tetraethyl ammonium tetrafluoroborate in 125 milliliters of acetonitrile. The composition was placed in an electrolytic cell having a carbon rod cathode, a platinum gauze anode, and a side reservoir. Oxygen was bubbled against the cathode to form superoxide, $O_2^-$. Thereafter 10 milliliters of toluene was added to the side reservoir, and electrolysis carried out for 12 hours at a current of 4 to 8 milliamperes, a cathode voltage of 0.95 volt, and an anode voltage of 1.0 to 2.2 volts.

The resulting product was recovered as described in Example I, hereinabove, analyzed, and found to contain benzyl alcohol, benzaldehyde, and benzoic acid.

While the invention has been described with respect to certain specific exemplifications, embodiments, and examples, the scope is not to be limited thereby, but only by the claims appended hereto.

I claim:

1. A method of synthesizing compounds chosen from the group consisting of benzyl alcohol, benzaldehyde, benzoic acid, mixtures thereof, phenoxy benzyl alcohol, phenoxy benzaldehyde, phenoxy benzoic acid, and mixtures thereof comprising:

(a) providing a composition comprising a current carrying component chosen from the group consisting of tetrafluoroborate salts and tetraethylammonium salts, a solvent, and a methyl aryl chosen from the group consisting of toluene and phenoxy toluene in contact with an anode and a cathode;

(b) reducing the solvent at the cathode; and (c) oxidizing the methyl substituted aryl at the anode whereby to form product.

2. The method of claim 1 wherein the solvent is water.

3. The method of claim 1 wherein the solvent is an aqueous solvent.

4. The method of claim 1 wherein the anode and the cathode are liquid permeable, comprising passing the composition from the cathode to and through the anode.

5. A method of synthesizing compounds chosen from the group consisting of benzyl alcohol, benzaldehyde, benzoic acid, mixtures thereof, phenoxy benzyl alcohol, phenoxy benzaldehyde, phenoxy benzoic acid, and mixtures thereof in an electrolytic cell having an anode, a cathode, and an ion selective permionic membrane therebetween, comprising:

(a) providing a composition containing a methyl aryl chosen from the group consisting of toluene and phenoxy toluene in contact with the anode and the permionic membrane;

(b) providing a composition containing a reducible source of oxygen in contact with the cathode and the permionic membrane;

(c) passing an electrical current through the electrolytic cell whereby to reduce the reducible source of oxygen at the cathode and oxidize the methyl substituted aryl at the anode.

6. The method of claim 5 wherein the anode and cathode are in contact with the ion selective permionic membrane.

7. The method of claim 5 wherein the reducible source of oxygen is molecular oxygen, the cathode is graphite, and superoxide is formed at the graphite cathode.

8. A method of synthesizing benzyl alcohol comprising:

(a) feeding toluene to the anolyte compartment of an electrolytic cell having an anolyte compartment, a catholyte compartment, and a solid ionic matrix therebetween;

(b) oxidizing toluene at the anode whereby to form benzyl alcohol and benzaldehyde;

(c) recovering an anolyte composition comprising benzyl alcohol and benzaldehyde;

(d) passing the anolyte liquor through a drying agent whereby to remove benzyl alcohol therefrom;

(e) separating the benzyl alcohol from the drying agent;

(f) returning the anolyte liquor, depleted in benzyl alcohol, to the catholyte compartment; and (g) reducing benzaldehyde at the cathode.

9. A method of synthesizing compounds chosen from the group consisting of benzyl alcohol, benzaldehyde, benzoic acid, mixtures thereof, phenoxy benzyl alcohol, phenoxy benzaldehyde, phenoxy benzoic acid, and mixtures thereof comprising:

(a) providing a composition comprising a current carrying component, a solvent, and a methyl aryl chosen from the group consisting of toluene and phenoxy toluene in contact with a liquid permeable anode and a liquid permeable cathode;

(b) reducing the solvent at the cathode; and (c) passing the methyl substituted aryl to and through the anode whereby to oxidize the methyl substituted aryl at the anode and form product.

10. The method of claim 9 wherein the current carrying component is chosen from the group consisting of tetrafluoroborate salts and tetraethylammonium salts.

11. The method of claim 9 wherein the solvent is water.

12. The method of claim 11 wherein the solvent is an aqueous solvent.

* * * * *